US011053622B2

(12) United States Patent
Marangoni et al.

(10) Patent No.: US 11,053,622 B2
(45) Date of Patent: Jul. 6, 2021

(54) LAUNDRY TREATING APPLIANCE WITH REMOVABLE BASKET

(71) Applicant: WHIRLPOOL CORPORATION, Benton Harbor, MI (US)

(72) Inventors: Alexandre L. Marangoni, Rio Claro (BR); Fernando Raiss Martins, Rio Claro (BR); Marcelo A. Santos, Rio Claro (BR); Eduardo Luis Violin, Rio Claro (BR)

(73) Assignee: Whirlpool Corporation, Benton Harbor, MI (US)

( * ) Notice: Subject to any disclaimer, the term of this patent is extended or adjusted under 35 U.S.C. 154(b) by 311 days.

(21) Appl. No.: 15/651,589

(22) Filed: Jul. 17, 2017

(65) Prior Publication Data

US 2019/0017208 A1 Jan. 17, 2019

(51) Int. Cl.

| | |
|---|---|
| ***D06F 13/00*** | (2006.01) |
| ***D06F 37/12*** | (2006.01) |
| ***D06F 37/24*** | (2006.01) |
| ***D06F 39/04*** | (2006.01) |
| ***D06F 39/08*** | (2006.01) |
| ***D06F 39/02*** | (2006.01) |
| ***D06F 37/16*** | (2006.01) |
| ***D06F 33/00*** | (2020.01) |

(Continued)

(52) U.S. Cl.

CPC ..... *D06F 37/12* (2013.01); *D06F 13/00* (2013.01); *D06F 33/00* (2013.01); *D06F 34/28* (2020.02); *D06F 37/16* (2013.01); *D06F 37/24* (2013.01); *D06F 39/024* (2013.01); *D06F 39/045* (2013.01); *D06F 39/083* (2013.01); *D06F 39/087* (2013.01); *D06F 37/14* (2013.01); *D06F 2222/00* (2013.01)

(58) Field of Classification Search

CPC ..... D06F 17/06; D06F 17/08; D06F 17/10; D06F 13/00; D06F 13/02; D06F 13/04; D06F 13/06; D06F 13/08; D06F 37/12; D06F 37/24; D06F 37/40

See application file for complete search history.

(56) References Cited

U.S. PATENT DOCUMENTS 1,795,395 A 3/1931 Hoke
2,019,089 A * 10/1935 Papworth ..... D06F 13/00 68/26

(Continued)

FOREIGN PATENT DOCUMENTS

BR DI7003246-7 10/2011
BR 102013015674 A2 7/2015

(Continued)

OTHER PUBLICATIONS

KR20150077264—Google Patents Machine Translation (Year: 2015).*

*Primary Examiner* — Marc Lorenzi
(74) *Attorney, Agent, or Firm* — McGarry Bair PC

(57) ABSTRACT

An apparatus for a laundry treating appliance including a first basket defining a first treating chamber for receiving laundry for treatment according to a selected cycle of operation. A first clothes mover can be provided in the first treating chamber. A removable basket assembly can include a second basket with a second clothes mover. A transmitter can be included in the removable basket assembly for operably coupling the second clothes mover to the first clothes mover.

16 Claims, 6 Drawing Sheets

(51) Int. Cl.
*D06F 34/28* (2020.01)
*D06F 37/14* (2006.01)

(56) References Cited

U.S. PATENT DOCUMENTS 2,218,275 A * 10/1940 Woodin ..... D06F 37/12 403/202
2,748,788 A 6/1956 Duckstein
3,014,358 A 12/1961 Bochan
3,026,699 A 3/1962 Rhodes
3,029,623 A 4/1962 Morey
3,145,551 A 8/1964 Ziegler
3,209,560 A 10/1965 Shelton
3,324,688 A * 6/1967 Hubbard ..... D06F 37/16 68/4
3,481,162 A 12/1969 Ziegler
3,509,741 A 5/1970 Morey
3,575,020 A 4/1971 Hubbard
3,648,486 A 3/1972 Rosinski, Jr. et al.
3,987,652 A 10/1976 Ruble
4,118,957 A 10/1978 Marcussen
4,162,621 A 7/1979 Stone
4,175,409 A 11/1979 Morey
4,186,573 A 2/1980 Brenner et al.
4,207,760 A 6/1980 Bochan
4,225,992 A 10/1980 Morey
4,338,802 A 7/1982 Dhmann et al.
4,417,457 A * 11/1983 Brenner ..... D06F 39/024 68/17 A
4,637,230 A 1/1987 Roberts
4,637,231 A 1/1987 McMillan et al.
4,920,770 A 5/1990 Dooley et al.
5,113,542 A 5/1992 Pastryk et al.
5,440,903 A 8/1995 Kropf et al.
5,497,638 A 3/1996 Berkcan et al.
5,500,967 A * 3/1996 Wilson ..... D06F 39/024 68/17 A
5,611,221 A 3/1997 Tremel
5,651,277 A * 7/1997 Richardson ..... D06F 37/40 68/133
5,689,847 A 11/1997 Tremel et al.
5,784,902 A 7/1998 Pinkowski et al.
6,460,382 B1 * 10/2002 Kim ..... D06F 37/304 68/140
7,401,479 B2 7/2008 Fields
7,866,191 B2 1/2011 Turner et al.
9,404,213 B2 8/2016 Kappler
2004/0116267 A1 6/2004 Mathieu et al.
2005/0284197 A1 12/2005 Pinkowski et al.
2007/0084254 A1 4/2007 Messina
2008/0312773 A1 12/2008 Nag
2009/0211108 A1 8/2009 Moschutz et al.
2009/0293203 A1 12/2009 Hettinger et al.
2011/0094902 A1 4/2011 Delehey et al.
2013/0276483 A1 * 10/2013 Ryu ..... D06F 37/40 68/12.24
2013/0312462 A1 * 11/2013 Kim ..... D06F 21/08 68/133
2015/0059417 A1 3/2015 Ramasco
2015/0184326 A1 7/2015 Seo et al.
2015/0211163 A1 7/2015 Kim et al.
2016/0201243 A1 7/2016 Bergamo
2016/0222567 A1 8/2016 Ramasco et al.
2016/0289884 A1 10/2016 Kim et al.
2019/0186064 A1 6/2019 Kim et al.

FOREIGN PATENT DOCUMENTS

BR 102013018364 A2 8/2015
BR 102013021866 A2 8/2015
BR 102013015672 A2 9/2015
BR 102013027400 A2 9/2015
BR 102013025343 A2 11/2015
BR 102014008903 A2 12/2015
BR 102014010905 A2 12/2015
BR 102014010908 A2 12/2015
BR 102014018397 A2 2/2016
CN 203530690 U 4/2014
CN 203729101 U 7/2014
CN 105220395 A 1/2016
KR 20030045447 A 6/2003
KR 20150077264 A * 7/2015
WO 2006087735 A1 8/2006
WO 2013088426 A2 6/2013
WO 2014201534 A1 12/2014
WO 2015048870 A1 4/2015
WO 2015058269 A1 4/2015

* cited by examiner

LAUNDRY TREATING APPLIANCE WITH REMOVABLE BASKET

BACKGROUND

Laundry treating appliances, such as clothes washers, refreshers, and non-aqueous systems, may have a configuration based on a rotating basket that defines a treating chamber in which laundry items are placed for treating. The laundry treating appliance may have a controller that implements a number of pre-programmed cycles of operation having one or more operating parameters. The controller may control a motor to rotate the basket according to one of the pre-programmed cycles of operation. The controller may control the motor to rotate the basket at the same speeds for a give pre-programmed cycle of operation regardless of the characteristics of the laundry items or changes in the system.

BRIEF SUMMARY

In one aspect, the disclosure relates to a laundry treating appliance including a first basket defining a first treating chamber for receiving laundry for treatment. A motor operably couples with the first basket for rotation of the first basket. A first clothes mover is disposed within the first treating chamber and operably couples to the motor for rotation within the first treating chamber. A second basket assembly is included with the laundry treating appliance and includes a second basket selectively receivable within at least a portion of the first treating chamber and is removably coupled to the clothes mover. The second basket defines a second treating chamber for receiving laundry for treatment. A second clothes mover is provided in the second treating chamber. A transmitter includes a body mounted to the second clothes mover and operably couples to the first clothes mover when the second basket is received within the at least a portion of the first treating chamber such that rotation of the first clothes mover can be transmitted to the second clothes mover through the transmitter.

In another aspect, the disclosure relates to a removable basket assembly for a laundry treating appliance having a first clothes mover, the basket assembly including a basket adapted to be selectively receivable within a portion of the laundry treating appliance, with the basket defining a treating chamber for receiving laundry for treatment according to a cycle of operation. A second clothes mover is provided within the treating chamber and is adapted for rotation within the basket. A transmitter has a body mounted to the second clothes mover. When the basket is received within the laundry treating appliance the body is operably coupled to the first clothes mover such that rotation of the first clothes mover can be transmitted to the second clothes mover through the transmitter.

DETAILED DESCRIPTION

Aspects of the disclosure relate to a laundry treating appliance including a dual-basket system including a lower basket and a removable basket assembly. A first treating chamber is formed by the lower basket and a second treating chamber is formed by a second basket in the removable basket assembly. A cycle of operation can be used to treat laundry articles within one or more of the first or second treating chambers. A first clothes mover can be provided in the first treating chamber and a second clothes mover can be provided in the second treating chamber. A transmitter can be used to operably couple the first clothes mover to the second clothes mover to impart movement from the first clothes mover to the second clothes mover.

In the situation where the dual-basket system is utilizing the removable basket assembly, the removable basket assembly can be placed on the first clothes mover in the lower basket to mount the removable basket assembly within the laundry treating appliance. The transmitter provides for transferring rotational force from the first clothes mover to the second clothes mover, as well as facilitating proper mounting of the removable basket assembly to the remainder of the laundry treating appliance.

The transmitter can be coupled to the removable upper basket to facilitate mounting and connection to the first clothes mover. The first clothes mover can include a set of blades and the transmitter can include a set of recesses adapted to receive the blades to mount the removable basket assembly. The blades received within the recesses can impart torque from the first clothes mover to the transmitter during operation. The transmitter can also couple or affix to the second clothes mover. The transmitter can impart torque or rotational movement to the second clothes mover within the second basket. A male connector on the transmitter and a female socket on the second clothes mover can facilitate transmission of the torque from the transmitter to the second clothes mover.

Figure 1:
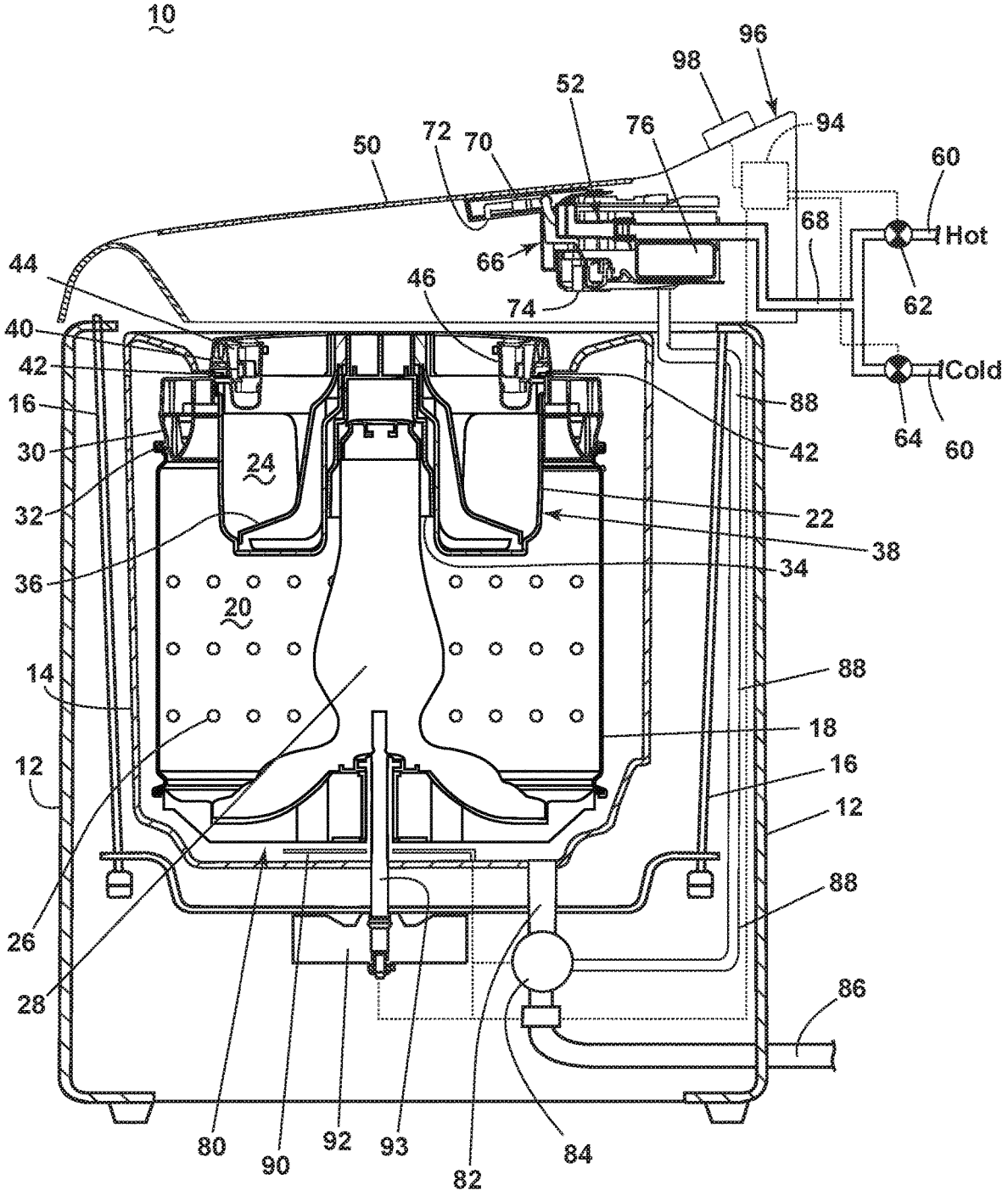
FIG. 1 is a schematic view of a laundry treating appliance in the form of a washing machine having a removable basket assembly and a lower basket with a first clothes mover.

Referring now to FIG. 1 a laundry treating appliance 10 can be any appliance which performs a cycle of operation to clean or otherwise treat items or articles placed therein, such as clothing laundry in one non-limiting example. The laundry treating appliance 10 is illustrated as a washing machine, which can include a structural support system comprising a cabinet 12 which defines a housing within which a laundry holding system resides. The cabinet 12 can be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry treating appliance 10 includes a tub 14 supported within the cabinet 12 by a suitable suspension system 16 for dynamically suspending portions of the laundry treating appliance 10 within the cabinet 12. A first basket 18 is provided within the tub 14 and defines a first treating chamber 20. The first basket 18 can include a plurality of perforations 26 such that liquid can flow between the tub 14 and the first basket 18 through the perforations 26. A first clothes mover 28 is provided the first treating chamber 20 to move or agitate laundry articles received in the first treating chamber 20 according to a cycle of operation. Clothes mover as used herein can mean any suitable clothes mover to impart mechanical energy to a load of laundry, such as an agitator, mover, blade, impeller, or auger in non-limiting examples. A balance ring 30 can be provided along an upper edge 32 of the first basket 18.

A removable basket assembly 38 can include a second basket 22 that is at least partially provided within the first basket 18 and defines a second treating chamber 24. A transmitter 34 can be included in the removable basket assembly 38 and can removably attach to the first clothes mover 28. The transmitter 34 facilitates attachment and removal of the removable basket assembly 38 to and from the first clothes mover 28 to position the second basket 22 at least partially within the first treating chamber 20. A second clothes mover 36 is provided within the second basket 22 and is coupled with the first clothes mover 28 via the transmitter 34.

An upper ring 40 can be included in the removable basket assembly 38 and can operably couple to the second basket 22. The upper ring 40 can include an outer diameter that is greater than a diameter of the second basket 22. The upper ring 40 can extend at least partially over and seat upon the balance ring 30, such that the balance ring 30 can at least partially support the removable basket assembly 38 at the upper ring 40. A set of outlets 42 can be provided in the upper ring 40 to provide egress for liquid from the second basket 22. A set as used herein can include any number of elements, including only one. A detergent dispenser 44 and a fabric softener dispenser 46 can mount along the interior of the upper ring 40 and extend into the second treating chamber 24. Furthermore, the upper ring 40 can partially form the dispensers 44, 46. While the dispensers 44, 46 are described as specific to detergent and fabric softener, the dispensers 44, 46 can be used for dispensing any suitable treating chemistry into the second basket 22, which can be particular to a cycle of operation, including but not limited to water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

It should be appreciated that the removable basket assembly 38 is removable, such that the laundry treating appliance 10 can be used with or without the removable basket assembly 38. The balance ring 30 on the first basket 18 and the transmitter 34 coupled to the first clothes mover 28 are used to support the removable basket assembly 38.

The laundry treating appliance 10 can further include a door 50 which can be movably mounted to the cabinet 12 to selectively close the tub 14, the first basket 18, or the second basket 22. The laundry treating appliance 10 can further include a liquid supply system 52 for supplying water to the laundry treating appliance 10 for use in treating laundry during a cycle of operation. The liquid supply system 52 can include a source of water, such as a household water supply 60, which can include separate valves 62 and 64 for controlling the flow of hot and cold water, respectively. Water can be supplied to a liquid manifold 66 via a supply conduit 68. Optionally, one or more additional valves can be included on the supply conduit 68 to selectively provide water to the liquid manifold 66, or to tailor water temperature from the household water supply 60. A water dispenser 70, fluidly coupled to the liquid manifold 66, can mount to the door 50, for providing water to one or more of the first and second baskets 18, 22 via a first outlet 72. The water dispenser 70 can overhang above the first and second baskets 18, 22 such that water dispensed from the first outlet 72 can pass into the second basket 22 when using the removable basket assembly 38, or into the first basket 22 when the removable basket assembly 38 is not being used. A second outlet 74 can be provided on the liquid manifold 66 dedicated to the first basket 18. The second outlet 74 can be positioned outside of the second basket 22, such that any dispensed water will pass into the space between the tub 14 and the upper ring 40, passing into the first treating chamber 20, but not into the second treating chamber 24. The water dispenser 70 can be dedicated to the removable basket assembly and the second outlet 74 can be dedicated to the first basket 18; however, the laundry treating appliance 10 should not be so limited.

A dispenser 76 can be provided within or adjacent to the liquid manifold 66 and in fluid communication with the liquid manifold 66. The dispenser 76 can be used to dispense treating chemistry to the first basket 18 through the second outlet 74. Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. In one non-limiting example, the detergent dispenser 44 can be a dispenser as disclosed in U.S. Pub. No. 2015/0059417 to Ramasco, filed Aug. 27, 2014 entitled "Valved Dispensing System for Products in Liquid Form by Inertial Centrifugal Action for Household Appliances," which is herein incorporated by reference in full.

The removable basket assembly 38 can further include coupling elements disposed on the periphery of the second basket 22. Such coupling elements can couple the removable basket assembly 38 to the first basket 18 and permit common rotation among the two. In one non-limiting example, the coupling elements can be similar to those as disclosed in U.S. Pub. No. 2016/0222567 to Ramasco et al., filed Oct. 23, 2015, entitled "Coupling System of Removable Compartment for Appliances," now U.S. Pat. No. 9,863,078, issued Jan. 9, 2018, which is herein incorporated by reference in full, and the removable basket assembly 38 can couple in the same manner as described therein.

The laundry treating appliance 10 can also include a recirculation and drain system for recirculating or draining liquid within the laundry treating appliance 10. Liquid supplied to the tub 14 typically enters a space between the tub 14 and the first basket 18 and can flow by gravity to a sump 80 formed in part by a lower portion of the tub 14. The sump 80 can also be formed by a sump conduit 82 that can fluidly couple the lower portion of the tub 14 to a pump 84. The pump 84 can direct liquid to a drain conduit 86, which can drain the liquid from the laundry treating appliance 10, or to a recirculation conduit 88, which can direct the liquid from the sump conduit 82 into the liquid manifold 66, which can be returned to one or more of the first or second treating chambers 20, 24. In this manner, liquid provided to the tub 14, with or without treating chemistry can be recirculated into either the first or second treating chambers 20, 24 for treating the laundry per one or more cycles of operation.

The liquid supply and/or recirculation and drain system can be provided with a heating system which can include one or more devices for heating laundry and/or liquid supplied to the tub 14, such as a sump heater 90, which can be used to heat the laundry and/or liquid within the tub 14 as part of a cycle of operation.

Additionally, the liquid supply, recirculation and drain system can differ from the configuration shown in FIG. 1, such as by inclusion of other valves, conduits, treating chemistry dispensers, sensors, such as water level sensors and temperature sensors, and the like, to control the flow of liquid through the laundry treating appliance 10 and for the introduction of more than one type of treating chemistry.

The laundry treating appliance 10 also includes a drive system for rotating the first and second baskets 18, 22 within the tub 14. The drive system can include a motor 92, which can be directly coupled with the first basket 18 and the first clothes mover 28 through a drive shaft 93 to rotate or reciprocate the first basket 18 or the first clothes mover 28 about a rotational axis during a cycle of operation. Additionally, the rotational movement of the first clothes mover 28 can be imparted to the second clothes mover 36 and rotational movement of the first basket 18 can be imparted to the second basket 22. The motor 92, in one non-limiting example, can be a brushless permanent magnet (BPM) motor. Other motors, such as an induction motor or a permanent split capacitor (PSC) motor, can also be used. The motor 92 can rotate the first basket 18 and the second basket 22 at various speeds in either rotational direction, and can reciprocate the first and second clothes movers 28, 36 within its respective basket.

The laundry treating appliance 10 also includes a control system for controlling the operation of the laundry treating appliance 10 to implement one or more cycles of operation. The control system can include a controller 94 located within the cabinet 12 and a user interface 96 that is operably coupled with the controller 94. The controller 94 operably couples to the liquid supply system 52 and the user interface 96. The user interface 96 is configured to receive input from a user and provide output to the user. Such input can be used to select a cycle of operation, for example, and output can include information related to the cycle of operation, such as status. The input can be communicated to the controller 94, indicative of and including instructions to execute the cycle of operation. The user interface 96 can include one or more knobs 98, dials, switches, displays, touch screens and the like for communicating with the user, such as to receive input and provide output. The user can enter different types of information including, without limitation, cycle selection and cycle parameters, such as cycle options.

The controller 94 can include the machine controller and any additional controllers provided for controlling any of the components of the laundry treating appliance 10. For example, the controller 94 can include the machine controller and a motor controller. It is contemplated that the controller 94 is a microprocessor-based controller that implements control software and sends/receives one or more electrical signals to/from each of the various working components to effect the control software.

Figure 2:
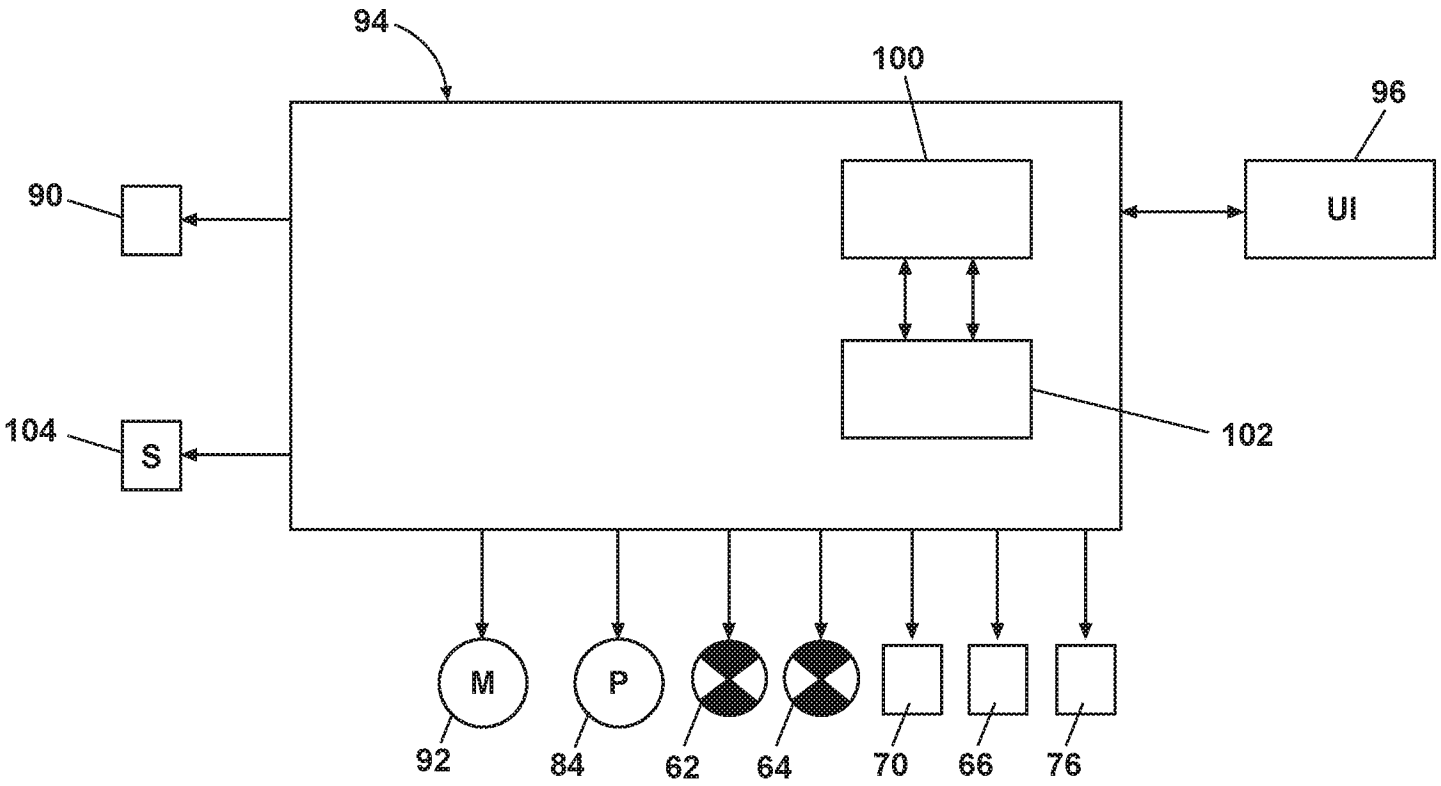
FIG. 2 is a schematic of a control system of the laundry treating appliance of FIG. 1.

Referring to FIG. 2, the controller 94 can be provided with a memory 100 and a central processing unit (CPU) 102. The memory 100 can be used for storing the control software that is executed by the CPU 102 in completing a cycle of operation using the laundry treating appliance 10 and any additional software. Examples, without limitation, of cycles of operation include: wash, heavy duty wash, delicate wash, quick wash, pre-wash, refresh, rinse only, and timed wash.

The controller 94 can be operably coupled with one or more components of the laundry treating appliance 10 for communicating with and controlling the operation of the component to complete a cycle of operation. For example, the controller 94 can be operably coupled with the motor 92, the pump 84, the liquid manifold 66, the water dispenser 70, the dispenser 76, the sump heater 90 which can be provided throughout the laundry treating appliance 10 to implement the operation of these and other components to implement one or more of the cycles of operation. Additional instruction or communication can be sent to or received from a user through the user interface 96.

The controller 94 can also be coupled with one or more sensors 104 provided in one or more of the systems of the laundry treating appliance 10 to receive input from the sensors, which are known in the art and not shown for simplicity. Non-limiting examples of sensors 104 that can be communicably coupled with the controller 94 include: a treating chamber temperature sensor, a moisture sensor, a weight sensor, a chemical sensor, a position sensor and a motor torque sensor, which can be used to determine a variety of system and laundry characteristics, such as laundry load inertia or mass. One particular sensor can be a position sensor to determine whether the removable basket assembly 38 is positioned within the laundry treating appliance 10. Another particular sensor can be a flow meter, which can be used to measure and control the amount of water filling the removable basket assembly 38. The flow meter could minimize or prevent the occurrence of water leaving the removable basket assembly 38 during the filling phase, and minimize contamination potential with the first basket 18. Yet another particular sensor can include a sensor for determining the presence of the removable basket assembly 38. Additionally, detection of the removable basket assembly 38 can be detected in a manner disclosed in U.S. Pat. Pub. No. 2016/0201243 to Bergamo, filed Oct. 23, 2015, entitled "Detection System of Washing Machines Removable Basket and Method for Detection of Washing Machines Removable Basket," now U.S. Pat. No. 9,777,419, issued Oct. 3, 2017, which is herein incorporated by reference in full.

The laundry treating appliance 10 can be operated with both the first basket 18 and the second basket 22, simultaneously, or can be operated with either the first basket 18 or the second basket 22 individually. When executing a cycle of operation within the first basket 18 without the removable basket assembly 38, the second basket 22, including the transmitter 34, can be removed from the laundry treating appliance 10. When using the removable basket assembly 38 alone, laundry articles need to be provided only in the second basket 22. In such an organization, the removable basket assembly 38 mounts on the first clothes mover 28. Rotational or reciprocating movement of the first clothes mover 28 is transferred to the second clothes mover 36 via the transmitter 34. When using both the first and second baskets 18, 22, the first basket 18 can be filled with laundry articles, then the removable basket assembly 38 installs over the first treating chamber 20, and the second basket 22 is filled with additional laundry articles. The reverse of the aforementioned process can be used to remove laundry articles after a cycle of operation has completed.

In operation using both the removable basket assembly 38 and the first basket 18, treating chemistry can be provided in one or more of the dispensers 44, 46, 76, to treat the laundry articles according to a desired cycle of operation. A user can select a cycle of operation on the user interface 96, such as a standard wash cycle of operation. Different cycles of operation can be tailored to different or individual treating chambers, as well as different organizations, such as with or without the removable basket assembly 38. Water can fill the first basket 18 dispensed from the second outlet 74 and passing to fill the tub 14, and then filling the first basket 18 through the perforations 26. Water can simultaneously fill the second basket 22 dispensed from the first outlet 72 of the water dispenser 70. Detergent can be dispensed into the first treating chamber 20 from the dispenser 76 in the liquid manifold 66 and can be dispensed into the second treating chamber 24 from the dispensers 44, 46 on the upper ring 40. The first and second clothes movers 28, 36 can agitate the articles within the first and second treating chambers 20, 24, respectively. Rotational or reciprocating movement of the first clothes mover 28 is translated to the second clothes mover 36 via the transmitter 34. After completion of the wash cycle, the liquid can drain from the first treating chamber 20 into the tub 14. The motor 92 can then rotate the first basket 18 and impart rotational movement to the second basket 22. The rotational movement of the second basket 22 can drive liquid within the second basket 22 outward and upward toward the outlets 42, where water can drain over the balance ring 30 and into the tub 14 exterior of the first basket 18. The liquid can drain from the laundry treating appliance 10 through the drain conduit 86. A rinse cycle can then begin, refilling both the first and second treating chambers 20, 24 in the same manner as the wash cycle. The water can be again drained and a spin cycle can begin. Rotational movement is transferred from the motor to the second basket 22 via the first basket 18. Liquid can drain from the first and second treating chamber 20, 24 in the same manner as draining the wash cycle. As such, the first and second treating chambers 20, 24 can treat two individual loads of articles separately, but simultaneously.

Alternatively, the second basket 22 can be used alone. The operation can be similar to that described above, without filling, draining, or treating any articles within the first treating chamber 20. Rotational or reciprocating movement is still imparted to the first basket 18 and the first clothes mover 28, which is transferred to the second basket 22 and the second clothes mover 36, respectively, in order to treat articles in the second basket 22.

Alternatively, the first basket 18 can be used alone. The removable basket assembly 38 can be removed and the first basket 18 can treat a load of laundry in a manner similar to that of a traditional laundry treating appliance 10. In yet another alternative, the removable basket assembly 38 can remain on top of the first basket 18, and the first treating chamber 20 can be used to treat a load of laundry articles while carrying the removable basket assembly in a manner described above, without the steps involved with treating articles within the second basket 22.

Figure 3:
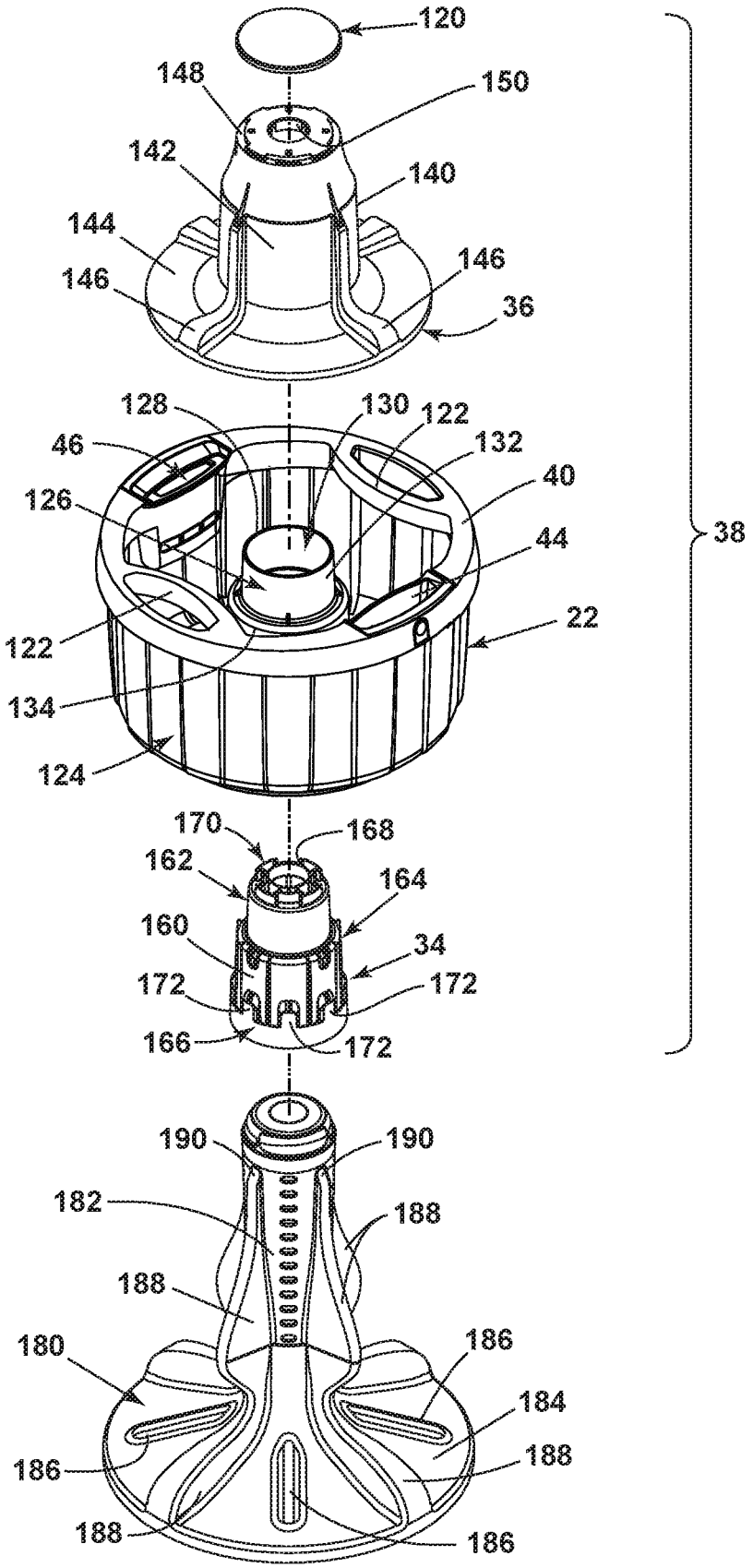
FIG. 3 is an exploded view of the removable basket assembly of FIG. 1 and the first clothes mover.

Referring now to FIG. 3 illustrating the basket assembly 38 in more detail, a cover 120 is included in the removable basket assembly 38. Two handles 122 can be provided in the upper ring 40, spaced between the first and second dispenser 44, 46. An exterior wall 124 can form the radial extent of the second basket 22. An interior wall 126 terminates at an upper edge 128 and can be separated into an upper portion 132 and a lower portion 134. A central aperture 130 is defined within the second basket 22 by the interior wall 126.

A clothes mover body 140 for the second clothes mover 36 includes a sidewall 142 transitioning into a bottom wall 144. A set of blades 146 can be provided on the clothes mover body 140 extending along at least a portion of the sidewall 142 and transitioning along the bottom wall 144. A top wall 148 can form an upper terminal edge for the sidewall 142. A female connector 150 can be provided on the top wall 148. The cover 120 can be adapted to couple to the second clothes mover 36 at the top wall 148 to cover a female connector 150. The sidewall 142, bottom wall 144, and the top wall 148 are sized to surround the interior wall 126 of the second basket 22, while remaining spaced from the upper edge 128 when assembled.

A transmitter body 160 can form the transmitter 34, and can be arranged into an upper section 162, an intermediate section 164, and a lower section 166. An upper edge 168 forms the terminal end of the upper section 162. A male connector 170 can be provided on the upper edge 168 and is adapted to be received by the female connector 150 of the second clothes mover 36. It should be appreciated that the male connectors 170 and the female connector 150 on the second clothes mover 36 can be interchangeable, having one of the male or female connectors 150, 170 on the second clothes mover 36 and the other on the transmitter 34. The upper section 162 can be sized to fit within the interior wall 126 of the second basket 22. The intermediate section 164 can have a greater diameter than that of the upper section 162 and can transition into the upper section 162. The intermediate section 164 can be sized fit within the lower portion 134 of the second basket 22. The lower section 166 can have a diameter that is greater than that of the intermediate section 164 and can transition into the intermediate section 164. A set of protrusions 172 are formed in the lower section 166 extending toward the intermediate section 164.

The first clothes mover 28 can include a sidewall 182 and a bottom wall 184. A set of movers 186 are provided on the bottom wall 184 adapted to move laundry along the bottom wall 184. A set of blades 188 can be partially formed on the first clothes mover 28 extending from the bottom wall 184 along the sidewall 182 and provided between the movers 186. The blades 188 extend at least partially along the length of the first clothes mover 28, terminating at a set of blade ends 190.

In assembly of the removable basket assembly 38 the transmitter 34 can insert through the central aperture 130 of the second basket 22. The sizing of the upper portion 132 of the interior wall 126 can be complementary to the upper section 162 of the transmitter 34 to extend the male connector 170 beyond the upper edge 128 of the interior wall 126. Furthermore, the lower portion 134 can be sized to surround the intermediate and lower sections 164, 166, while the upper portion 132 includes a diameter that is too small to permit insertion of the intermediate and lower sections 164, 166.

The second clothes mover 36 can insert over the interior wall 126 of the second basket 22. Removal of the upper ring 40 may be required to fit the second clothes mover 36 within the second basket 22. The clothes mover body 140 pass over the interior wall 126 until the male connector 170 is received in and coupled to the female connector 150. As the male connector 170 extends beyond the upper edge 128 of the interior wall 126, the second clothes mover 36 can be spaced within the second basket 22 while not contacting the second basket 22. The cover 120 can mount to the second clothes mover 36 over the female connector 150. In non-limiting example, the cover can secure to the second clothes mover 36 by way of press fit or weld.

In the spaced arrangement, unrestricted rotational or reciprocating movement of the second clothes mover 36 is possible within the second basket 22. Such connection of the removable basket assembly 38 can be fixed such that the transmitter fastens to the second clothes mover 36 through the second basket 22 and the cover fastens onto the female connector 150. The removable basket assembly 38 can then removably mount on the first clothes mover 28 as a single unit.

Figure 4:
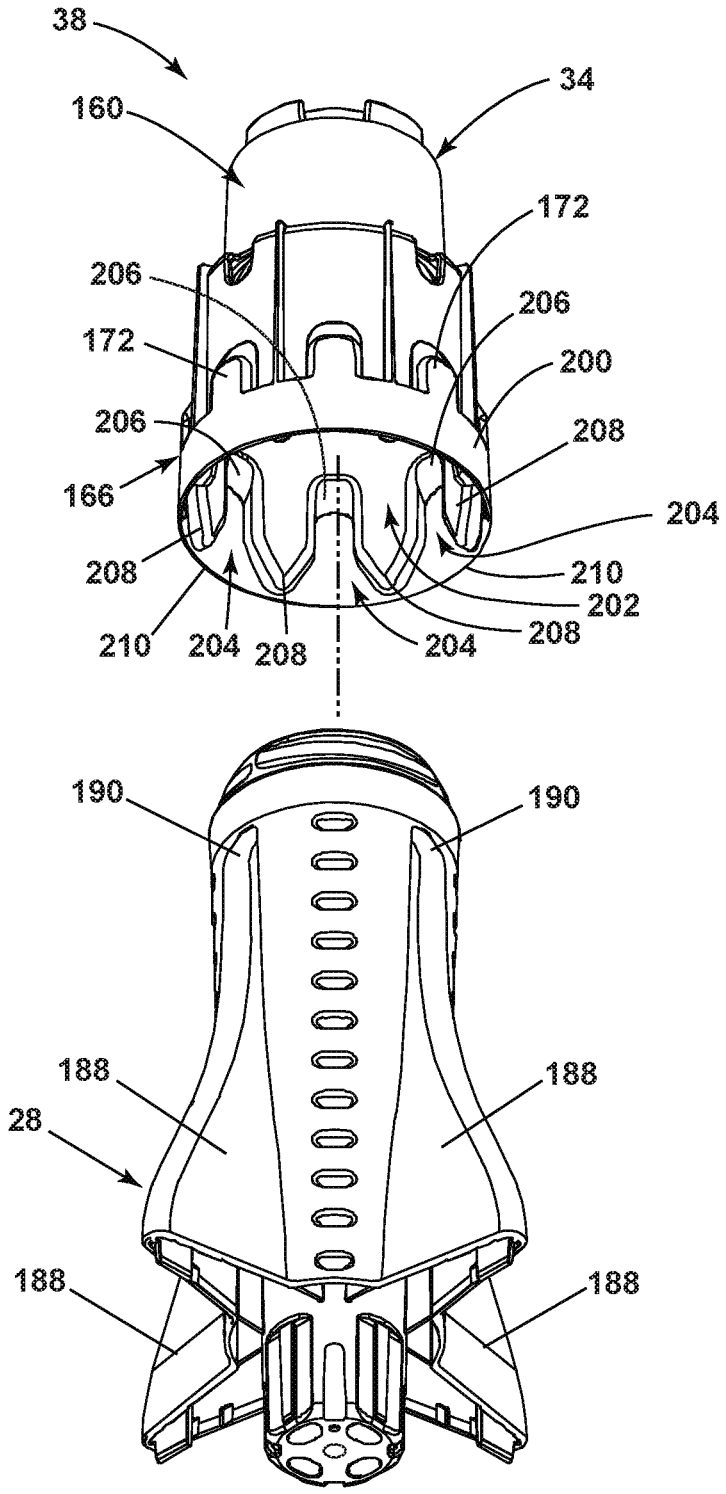
FIG. 4 is a bottom perspective of the exploded view of FIG. 3, illustrating sloped sections on the transmitter.

Referring now to FIG. 4, an exterior wall 200 can form the transmitter body 160 and the upper, intermediate, and lower sections 162, 164, 166. An interior 202 for the transmitter 34 can be defined by the exterior wall 200. The transmitter 34 can be sized to receive the first clothes mover 28 within the interior 202. A complementary set of recesses 204 can be defined in the interior 202 by the set of protrusions 172 in the exterior wall 200. The set of recesses 204 can each terminate at a recess end 206. A sloped portion 208 can be formed in the recess 204 at an inlet for the recess 204. The sloped portion 208 is wider than the remainder of the recesses 204.

The set of recesses 204 can be adapted to receive the set of blades 188 on the first clothes mover 28 in mounting the transmitter 34 (and the removable basket assembly 38) to the first clothes mover 28. The sloped portions 208 can be used to guide and facilitate insertion of the set of blades 188 into the set of recesses 204 during attachment. The sloped portions 208 can further correct an offset placement of the removable basket assembly 38 with respect to the first clothes mover 28. More specifically, the sloped portion 208 allows for misaligned blades to be directed into the recess 204. The number or recesses 204 can be greater or equal than the number of blades 188. In one non-limiting example, there can be eight recesses 204 and only four blades 188.

Figure 5:
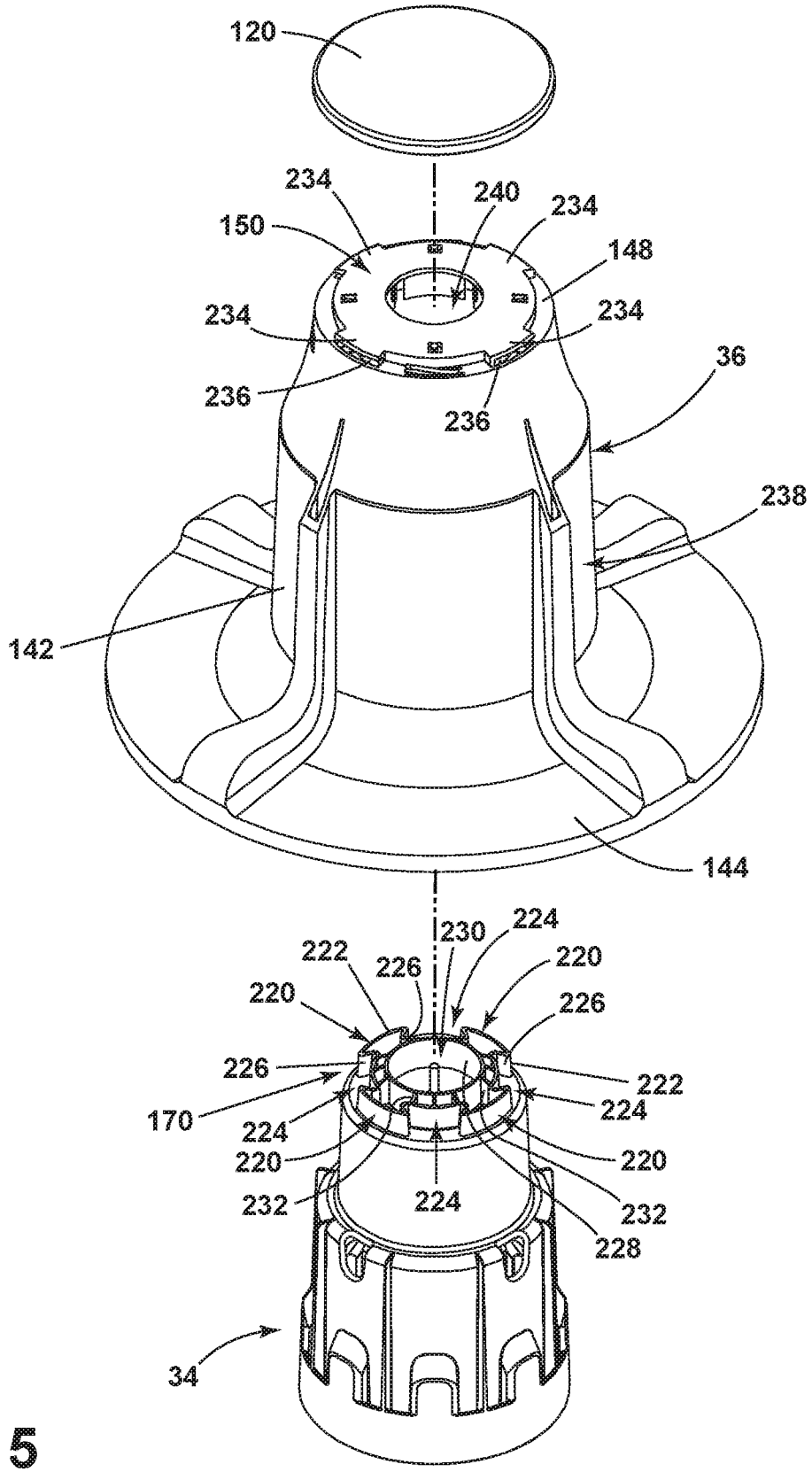
FIG. 5 is an exploded view of the transmitter and the second clothes mover of FIG. 3 illustrating a male connector on the transmitter and a female connector on the second clothes mover.

Referring now to FIG. 5, a male connector wall 222 can include a set of extensions 220 that form the male connector 170. The male connector wall 222 can include a variable geometry to define the set of extensions 220 spaced between a set of depressions 224. Transition portions 226 are formed along the male connector wall 222 between the extensions 220 and the depressions 224. An interior wall 228, connected to the male connector wall 222, can form a top aperture 230. A set of connector ribs 232 can extend from the interior wall 228 to the male connector wall 222 to improve rigidity of the male connector 170.

The female connector 150 can include a set of fingers 234 adapted to couple to the cover 120. The fingers 234 can include openings 236 adapted to rotatably couple to the cover 120 to secure the cover 120 to the second clothes mover 36. An outer wall 238 formed by the sidewall 142, the bottom wall 144, and the top wall 148, and can define an interior 240 for the second clothes mover 36.

Figure 6:
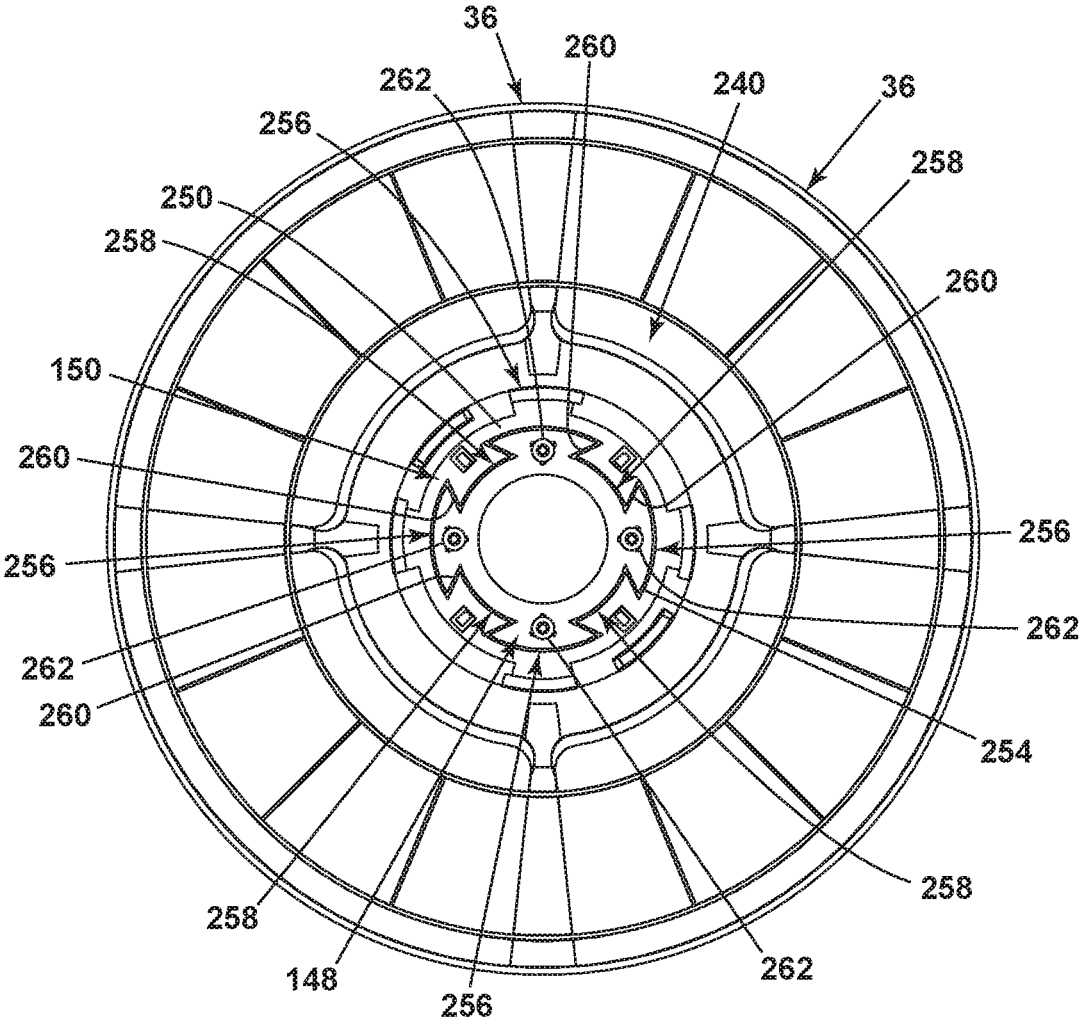
FIG. 6 is a top view of the transmitter aligned with a bottom view of the second clothes mover illustrating a plurality of ribs on the male connector of the transmitter adapted to be received within grooves on the female connector of the second clothes mover.
Figure 6:
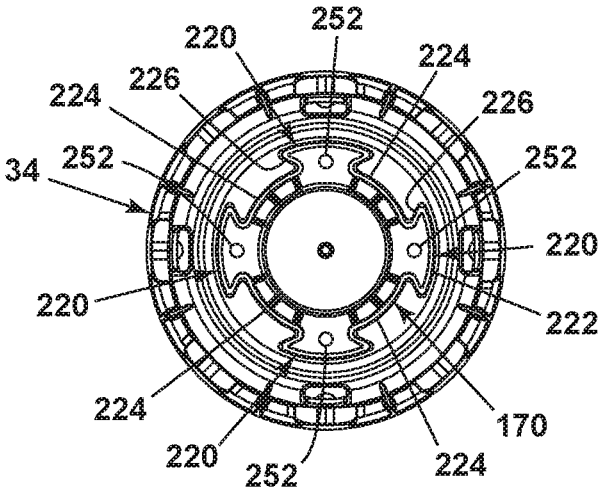

Referring to FIG. 6, a bottom view better illustrates the interior 240 of the second clothes mover 36 and an underside 250 of the female connector 150 adapted to couple to the male connector 170, shown in a top view.

A female connector wall 254 is provided within the female connector and is sized to receive the male connector wall 222 of the male connector 170. A set of extensions 256 on the female connector wall 254 are sized to surround the set of extensions 220. A set of depressions 258 and transition portions 260 are also formed by in female connector wall 254, complementary to the set of depressions 224 and the transition portions 226 of the male connector 170. A set of hollow posts 262 can extend from the top wall 148 of the female connector 150, extending into the interior 240 of the second clothes mover 36.

The male connector 170 can further include a set of receivers 252, adapted to couple to the set of posts 262 on the female connector 150. To attach the second clothes mover 36 to the transmitter 34, the male connector 170 couples to the female connector 150. The set of extensions 220 are adapted to be received at the set of extensions 256, and the set of depressions 224 are adapted to be received at the set of depressions 258. Furthermore, the posts 262 can weld or bolt to the receivers 252 to mechanically fasten the second clothes mover 36 to the transmitter 34.

When coupled, the transmitter 34 can transmit torque or rotational movement to the second clothes mover 36, such that movement of the transmitter 34 is reflected in movement of the second clothes mover 36. The organization of the complementary male connector wall 222 within the groove wall 254 transmits rotational or reciprocating movement from the transmitter 34 to the second clothes mover 36. Similarly, coupling of the transmitter 34 to the first clothes mover 28, as described in FIG. 4, transmits movement of the first clothes mover 28 to the transmitter 34. Therefore, the transmitter 34 provides for transmitting or transferring torque or rotational movement from the first clothes mover 28 to the second clothes mover 36. Therefore, when utilizing the removable basket assembly 38 within the laundry treating appliance 10, a single motor can provide movement to both the first and second clothes movers 28, 36 simultaneously, without requiring an additional motor or a complex mechanical system to drive the second clothes mover 36 in addition to the first clothes mover 28.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A laundry treating appliance comprising:

a first basket defining a first treating chamber for receiving laundry for treatment;

a motor operably coupled with the first basket for rotation of the first basket;

a first clothes mover disposed in the first treating chamber and operably coupled to the motor for rotation within the first treating chamber, the first clothes mover comprising a set of blades extending from a bottom wall of the first clothes mover and along a length of the first clothes mover and terminating in a set of blade ends; and a removable basket assembly selectively receivable within at least a portion of the first treating chamber and removably coupled to the first clothes mover, the removable basket assembly, comprising:

a second basket defining a second treating chamber for receiving laundry for treatment;

a second clothes mover disposed in the second treating chamber, the second clothes mover comprising one of a plurality of extensions or a plurality of corresponding grooves disposed about a circumference of an interior wall of the second clothes mover;

a transmitter having a body comprising an interior and an exterior wall, the interior comprising a set of recesses adapted to receive the set of blade ends for coupling the transmitter to first clothes mover, the exterior wall of the transmitter comprising the other of the plurality of extensions or the plurality of corresponding grooves disposed about an outer circumference of the transmitter body for coupling the second clothes mover to the transmitter; and wherein when the second basket is rotatably coupled to the first basket and the second clothes mover is operably coupled to the first clothes mover via the transmitter and when the second basket is received within the at least a portion of the first treating chamber, rotation of the first clothes mover is transmitted to the second clothes mover through the transmitter and separately from rotational movement of the first basket and the second basket.

2. The laundry treating appliance of claim 1, wherein the set of recesses are greater in number than the set of blades.

3. The laundry treating appliance of claim 1, wherein the first clothes mover further comprises a sidewall, a set of movers are provided on the bottom wall and the set of blades extend along the sidewall and are spaced about a circumference of the sidewall.

4. The laundry treating appliance of claim 3, wherein the set of blades are provided between the set of movers.

5. The laundry treating appliance of claim 1, wherein the first treating chamber and the second treating chamber are configured to treat two individual loads of articles separately and simultaneously.

6. The laundry treating appliance of claim 1, wherein the second basket further comprises a set of outlets configured to provide egress for liquid from the second basket into a tub that is located exterior of the first basket.

7. The laundry treating appliance of claim 6, wherein the second basket further comprises an upper ring and the set of outlets are provided in the upper ring.

8. The laundry treating appliance of claim 1, wherein the transmitter body comprises an upper section, an intermediate section, and a lower section.

9. The laundry treating appliance of claim 8, wherein the lower section of the transmitter body is sized to receive a top portion of the first clothes mover.

10. The laundry treating appliance of claim 8, wherein the lower section of the transmitter body comprises the set of recesses on the interior.

11. The laundry treating appliance of claim 10, wherein a set of protrusions are formed on the exterior wall of the lower section.

12. The laundry treating appliance of claim 10, wherein each recess in the set of recesses terminates in a sloped portion such that the sloped portion is wider than the rest of the recess for correcting an offset placement of the second basket with respect to the first clothes mover.

13. The laundry treating appliance of claim 8, wherein the upper section of the transmitter comprises the other of the plurality of extensions or the plurality of corresponding grooves.

14. The laundry treating appliance of claim 8, wherein the intermediate section comprises a greater diameter than that of the upper section.

15. The laundry treating appliance of claim 14, wherein the intermediate section has a smaller diameter than the lower section.

16. The laundry treating appliance of claim 15, wherein the intermediate section is sized to fit within a lower portion of the second basket.

* * * * *